US006244353B1

(12) United States Patent
Greer

(10) Patent No.: US 6,244,353 B1
(45) Date of Patent: Jun. 12, 2001

(54) FIRE EXTINGUISHING DEVICE

(76) Inventor: Bromfield R. Greer, 122 W. Florence Ave. #22, La Habra, CA (US) 90631

( * ) Notice: Subject to any disclaimer, the term of this patent is extended or adjusted under 35 U.S.C. 154(b) by 0 days.

(21) Appl. No.: 09/728,850

(22) Filed: Dec. 1, 2000

(51) Int. Cl.[7] ..... A62C 37/10; A62C 37/08

(52) U.S. Cl. ..... 169/61; 169/19; 169/23; 169/26; 169/27; 169/37; 169/51; 169/64; 169/54; 169/60

(58) Field of Search ..... 169/51, 54, 56, 169/60, 61, 70, 19, 23, 26, 37

(56) References Cited

U.S. PATENT DOCUMENTS

| | | | | |
|---|---|---|---|---|
| D. 307,647 | | 5/1990 | Yamamura et al. . | |
| 3,713,491 | * | 1/1973 | Grabowksi et al. | 169/26 X |
| 3,897,828 | * | 8/1975 | Glover | 169/60 X |
| 4,691,783 | | 9/1987 | Stern et al. . | |
| 4,895,208 | * | 1/1990 | Alasio | 169/54 |
| 5,016,715 | | 5/1991 | Alasio . | |
| 5,123,490 | | 6/1992 | Jenne . | |
| 5,315,292 | * | 5/1994 | Prior | 169/61 X |
| 5,617,923 | * | 4/1997 | Nishikubo et al. | 169/51 |
| 5,808,541 | | 9/1998 | Golden . | |
| 5,881,819 | | 3/1999 | Walters et al. . | |

* cited by examiner

*Primary Examiner*—David A. Scherbel
*Assistant Examiner*—Robin O. Evans

(57) ABSTRACT

A fire extinguishing device for extinguishing a fire from a stationary fire extinguisher. The fire extinguishing device includes a housing having a top wall. A peripheral wall is integrally coupled to and extending downwardly away from the top wall such that the housing has an open bottom side. A canister for disbursing a fire retardant material is securely coupled to an inner surface of the top wall such that a valve mechanically coupled to the canister is directed towards the open bottom side. The canister contains a fire retardant material in a respectively pressurized environment. Control circuitry for actuating the valve is securely coupled to an inner surface of the peripheral wall and is operationally coupled to the valve. A sensor for sensing relatively high heat is electronically coupled to the control circuitry. The sensor is securely attached to the peripheral wall. A plurality of fastening members removably fastens the bottom wall to a ceiling wall.

5 Claims, 4 Drawing Sheets

FIRE EXTINGUISHING DEVICE

BACKGROUND OF THE INVENTION

1. Field of the Invention

The present invention relates to fire extinguishing devices and more particularly pertains to a new fire extinguishing device for extinguishing a fire from a stationary fire extinguisher.

2. Description of the Prior Art

The use of fire extinguishing devices is known in the prior art. More specifically, fire extinguishing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,315,292; U.S. Pat. No. 5,016,715; U.S. Pat. No. 5,123,490; U.S. Pat. No. 5,808,541; U.S. Pat. No. 5,881,819; U.S. Des. Pat. No. 307,647; and U.S. Pat. No. 4,691,783.

While these devices fulfill their respective, particular objectives and requirements, the aforementioned patents do not disclose a new fire extinguishing device. The inventive device includes a housing having a top wall. A peripheral wall is integrally coupled to and extending downwardly away from the top wall such that the housing has an open bottom side. A canister for disbursing a fire retardant material is securely coupled to an inner surface of the top wall such that a valve mechanically coupled to the canister is directed towards the open bottom side. The canister contains a fire retardant material in a respectively pressurized environment. Control circuitry for actuating the valve is securely coupled to an inner surface of the peripheral wall and is operationally coupled to the valve. A sensor for sensing relatively high heat is electronically coupled to the control circuitry. The sensor is securely attached to the peripheral wall. A plurality of fastening members removably fastens the bottom wall to a ceiling wall.

In these respects, the fire extinguishing device according to the present invention substantially departs from the conventional concepts and designs of the prior art, and in so doing provides an apparatus primarily developed for the purpose of extinguishing a fire from a stationary fire extinguisher.

SUMMARY OF THE INVENTION

In view of the foregoing disadvantages inherent in the known types of fire extinguishing devices now present in the prior art, the present invention provides a new fire extinguishing device construction wherein the same can be utilized for extinguishing a fire from a stationary fire extinguisher.

The general purpose of the present invention, which will be described subsequently in greater detail, is to provide a new fire extinguishing device apparatus and method which has many of the advantages of the fire extinguishing devices mentioned heretofore and many novel features that result in a new fire extinguishing device which is not anticipated, rendered obvious, suggested, or even implied by any of the prior art fire extinguishing devices, either alone or in any combination thereof.

To attain this, the present invention generally comprises a housing having a top wall. A peripheral wall is integrally coupled to and extending downwardly away from the top wall such that the housing has an open bottom side. A canister for disbursing a fire retardant material is securely coupled to an inner surface of the top wall such that a valve mechanically coupled to the canister is directed towards the open bottom side. The canister contains a fire retardant material in a respectively pressurized environment. Control circuitry for actuating the valve is securely coupled to an inner surface of the peripheral wall and is operationally coupled to the valve. A sensor for sensing relatively high heat is electronically coupled to the control circuitry. The sensor is securely attached to the peripheral wall. A plurality of fastening members removably fastens the bottom wall to a ceiling wall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fire extinguishing device apparatus and method which has many of the advantages of the fire extinguishing devices mentioned heretofore and many novel features that result in a new fire extinguishing device which is not anticipated, rendered obvious, suggested, or even implied by any of the prior art fire extinguishing devices, either alone or in any combination thereof.

It is another object of the present invention to provide a new fire extinguishing device which may be easily and efficiently manufactured and marketed.

It is a further object of the present invention to provide a new fire extinguishing device which is of a durable and reliable construction.

An even further object of the present invention is to provide a new fire extinguishing device which is susceptible of a low cost of manufacture with regard to both materials and labor, and which accordingly is then susceptible of low prices of sale to the consuming public, thereby making such fire extinguishing device economically available to the buying public.

Still yet another object of the present invention is to provide a new fire extinguishing device which provides in the apparatuses and methods of the prior art some of the advantages thereof, while simultaneously overcoming some of the disadvantages normally associated therewith.

Still another object of the present invention is to provide a new fire extinguishing device for extinguishing a fire from a stationary fire extinguisher.

Yet another object of the present invention is to provide a new fire extinguishing device which includes a housing having a top wall. A peripheral wall is integrally coupled to and extending downwardly away from the top wall such that the housing has an open bottom side. A canister for disbursing a fire retardant material is securely coupled to an inner surface of the top wall such that a valve mechanically coupled to the canister is directed towards the open bottom side. The canister contains a fire retardant material in a respectively pressurized environment. Control circuitry for actuating the valve is securely coupled to an inner surface of the peripheral wall and is operationally coupled to the valve. A sensor for sensing relatively high heat is electronically coupled to the control circuitry. The sensor is securely attached to the peripheral wall. A plurality of fastening members removably fastens the bottom wall to a ceiling wall.

Still yet another object of the present invention is to provide a new fire extinguishing device that may be positioned in a vertical orientation on a ceiling or in a horizontal orientation on a wall.

Even still another object of the present invention is to provide a new fire extinguishing device that may be positioned wherever needed and will discharge without a person actuating the device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
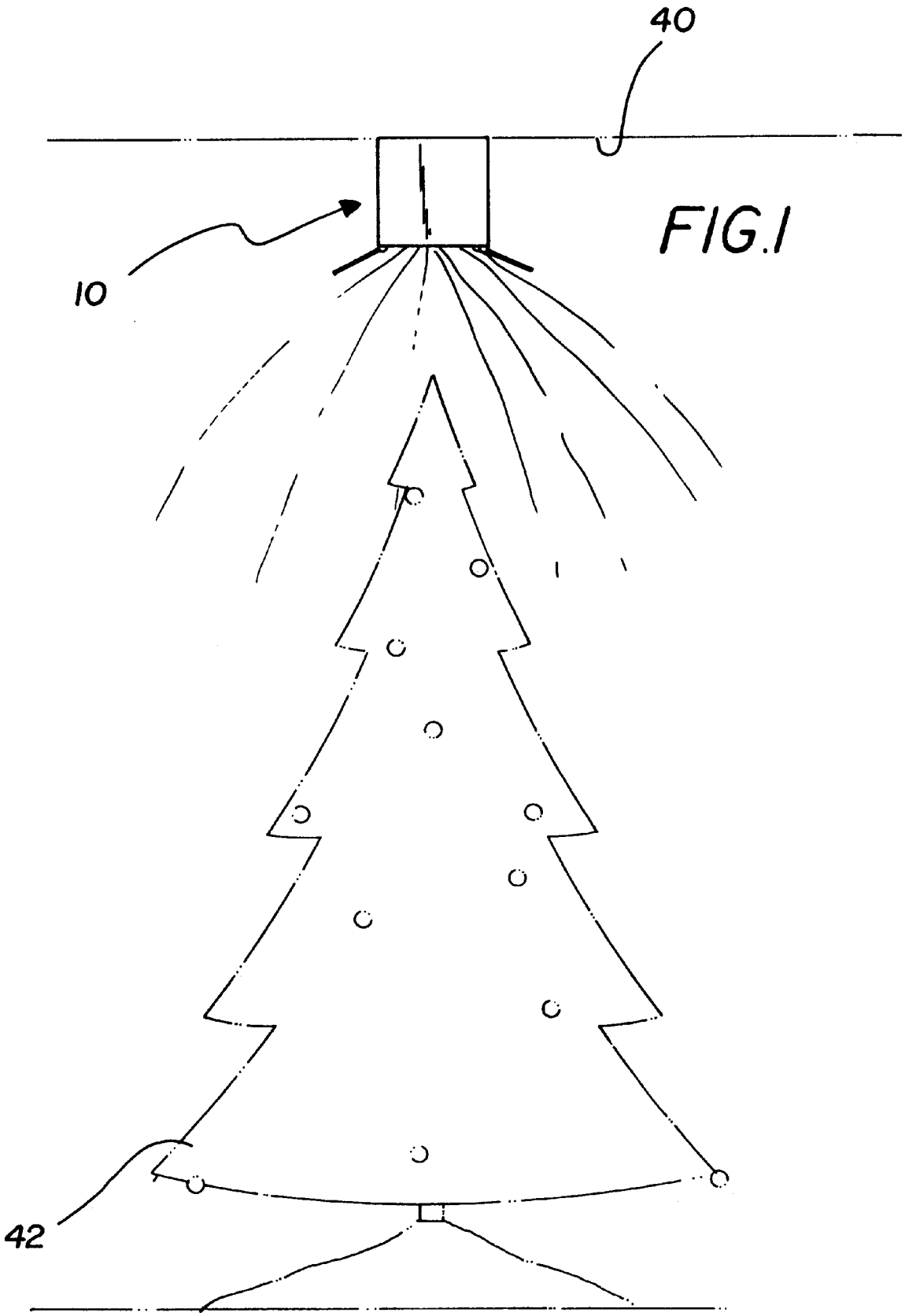
FIG. 1 is a schematic side in-use view of a new fire extinguishing device according to the present invention.
Figure 2:
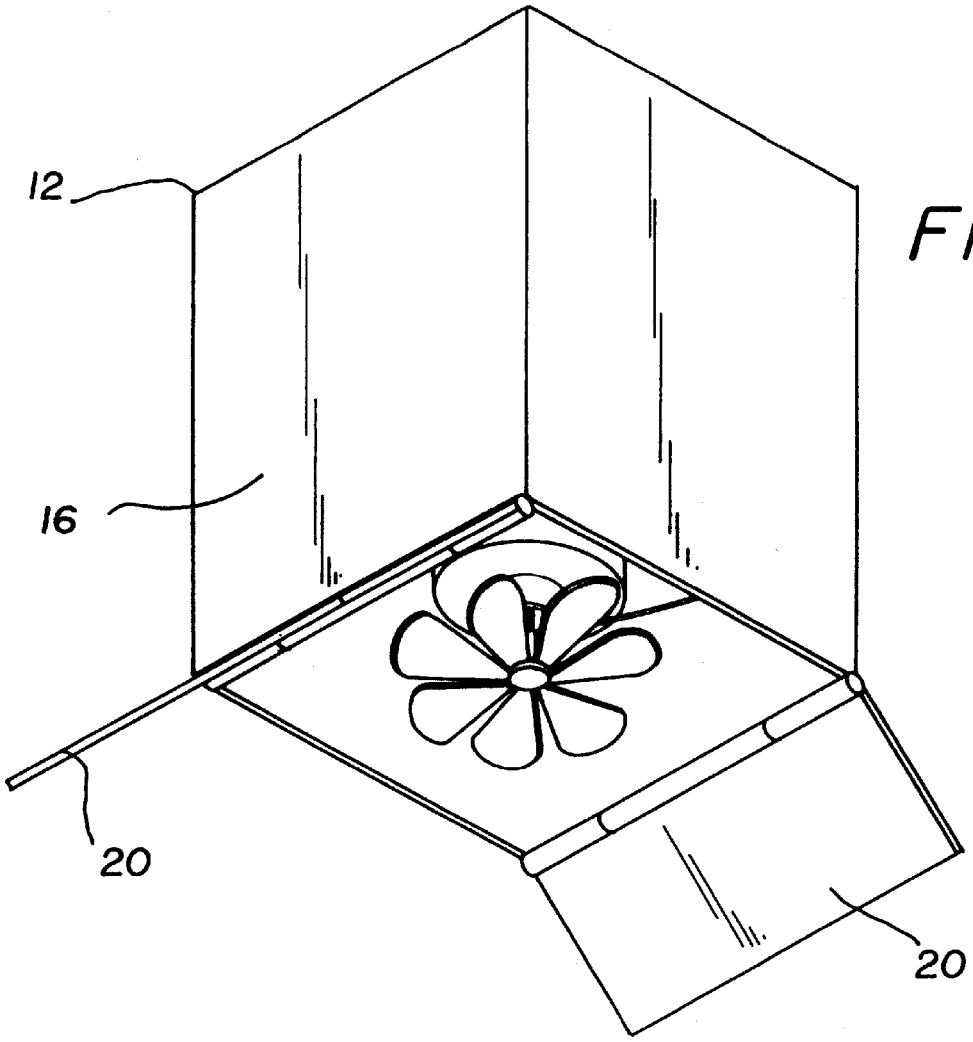
FIG. 2 is a schematic perspective bottom view of the present invention.
Figure 4:
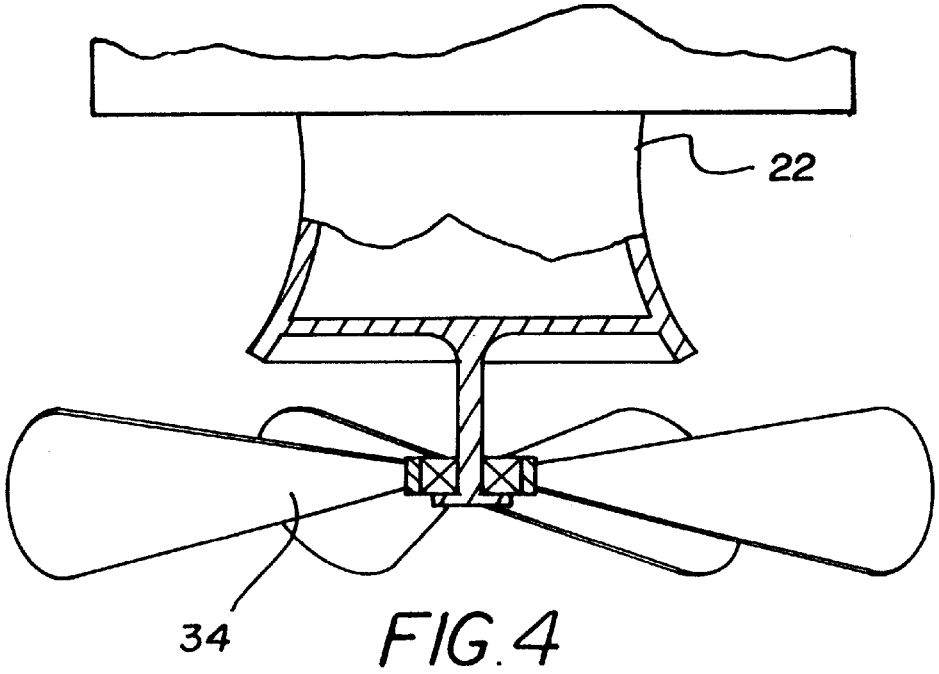
FIG. 4 is a schematic exploded view of the propeller of the present invention.
Figure 3:
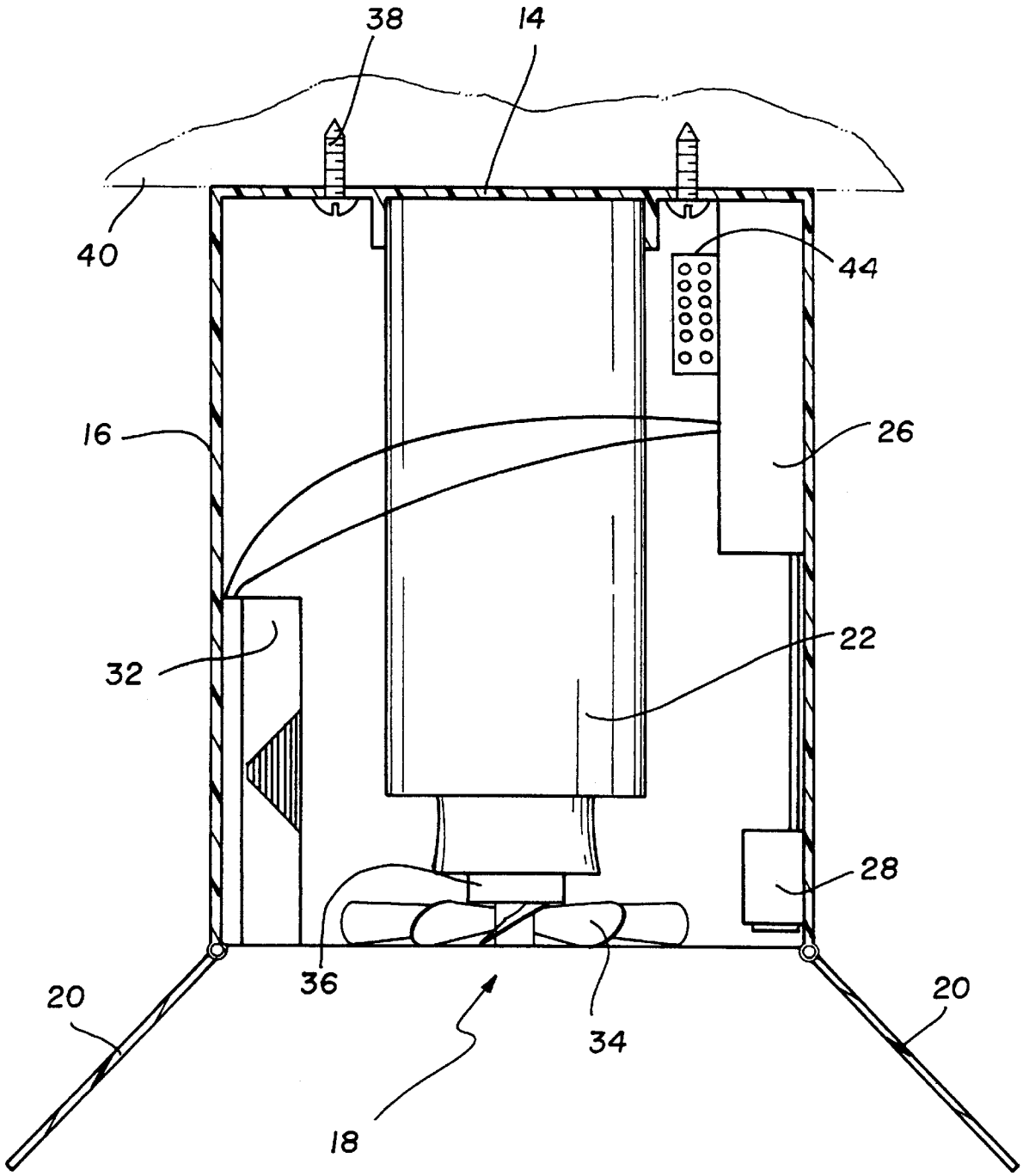
FIG. 3 is a schematic cross-sectional view of the present invention.
Figure 5:
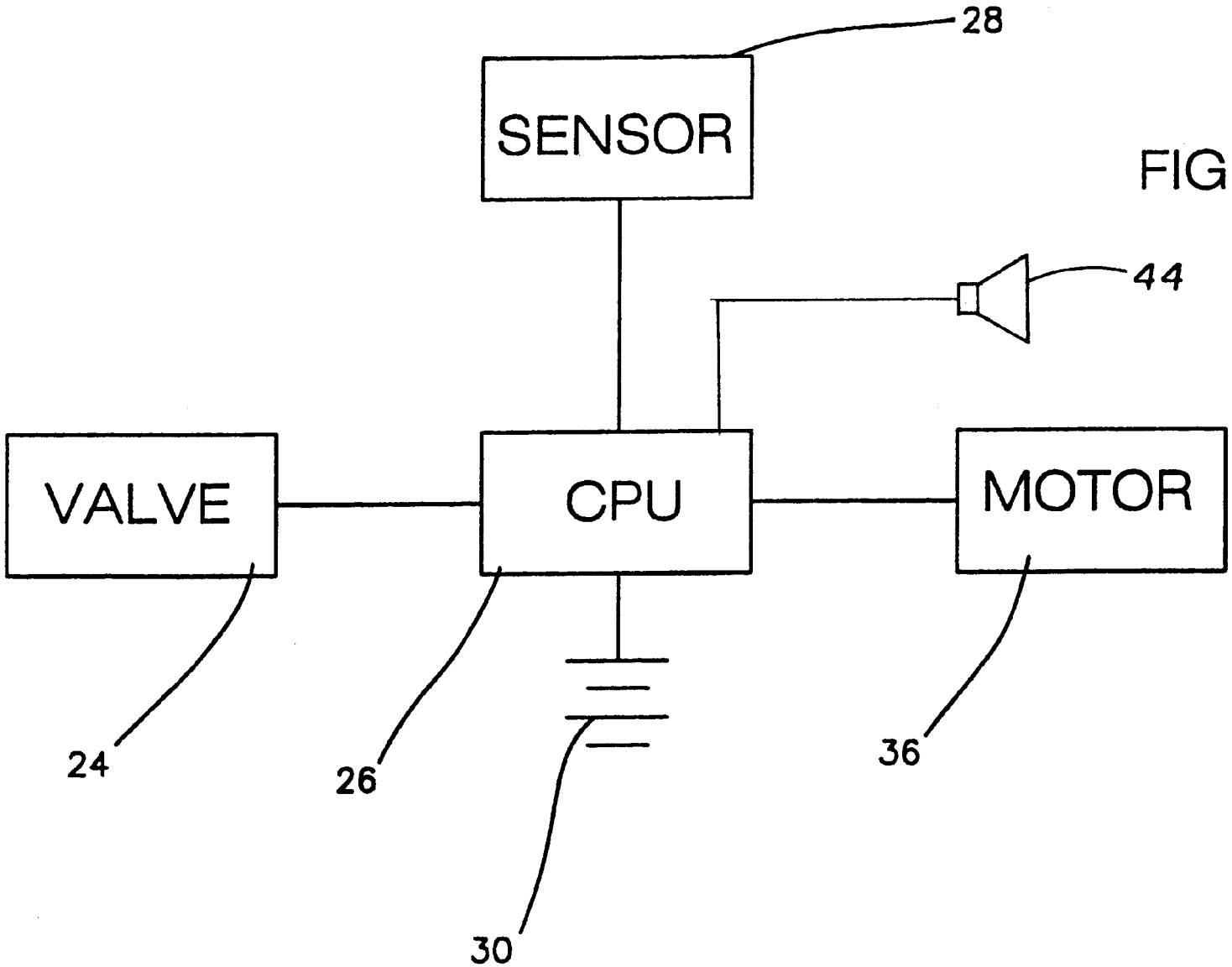
FIG. 5 is an electronic schematic view of the present invention.

With reference now to the drawings, and in particular to FIGS. 1 through 5 thereof, a new fire extinguishing device embodying the principles and concepts of the present invention and generally designated by the reference numeral 10 will be described.

As best illustrated in FIGS. 1 through 5, the fire extinguishing device 10 generally comprises a housing 12. The housing 12 has a top wall 14. A peripheral wall 16 is integrally coupled to and extends downwardly away from the top wall 14. The housing 12 has an open bottom side 18. Each of a pair of doors 20 is hingedly coupled to a free edge of the peripheral wall 16 for selectively closing the open bottom side 18. Each of the doors 20 is frictionally held in a closed position.

A canister 22 for disbursing a fire retardant material is securely coupled to an inner surface of the top wall 14 such that a valve 24 mechanically coupled to the canister 22 for releasing the contents of the canister 22 is directed towards the open bottom side 18. The canister 22 contains a conventional fire retardant material in a respectively pressurized environment.

Control circuitry 26 for actuating the valve 24 is securely coupled to an inner surface of the peripheral wall 16 and is operationally coupled to the valve 24.

A sensor 28 for sensing relatively high heat, over 120 degrees Fahrenheit, is electronically coupled to the control circuitry 26. The sensor 28 is securely attached to the peripheral wall 16. Preferably, the sensor 28 is adapted for detecting smoke as well.

A speaker 44 for producing an audible sound being securely mounted in the housing 12 and being electrically coupled to the control circuitry 26. The speaker 44 sounds an alarm when actuated by the control circuitry 26. Ideally, the sensor is adapted for detecting smoke and sounding the alarm before high heat is detected.

A power supply 30 for powering the control circuitry 26 is electrically coupled to the control circuitry 26. The power supply 30 is positioned in a container 32 in the housing 12 and ideally comprises a battery.

A propeller 34 for disbursing the fire retardant material is rotatably coupled to the canister 22 and is positioned between the canister 22 and the open bottom side 18.

A motor 36 for rotating the propeller 34 is positioned between the propeller 34 and the canister 22. The motor 36 is mechanically coupled to the propeller 34. The motor 36 is electrically coupled to the control circuitry 26.

A plurality of fastening members 38 removably fasten the bottom wall 14 to a ceiling 40. Each of the fastening members 38 comprises a screw extendable through the bottom wall 14 and into the ceiling 40.

In use, the device is positioned over areas wherever fire retardant material is needed and where the danger of a fire may be relatively higher. FIG. 1 shows such an example, a Christmas tree 42. The device is coupled to the ceiling. When the sensor detects relatively high heat, such as over 120 degrees Fahrenheit, the control circuitry actuates the valve which releases the pressurized contents of the can. This blows the doors open and causes the propeller to spin which distributes the contents in a cone-shaped pattern so that the fire retardant materials do not simply shoot straight down. The speaker sounds an alarm when actuated by the control circuitry when the sensor detects relatively high heat.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fire extinguishing device, said device being mountable to a ceiling, said device comprising:

a housing, said housing having a top wall, a peripheral wall being integrally coupled to and extending downwardly away from said top wall, said housing having an open bottom side;

a canister for disbursing a fire retardant material, said canister being securely coupled to an inner surface of said top wall such that a valve mechanically coupled to said canister is directed towards said open bottom side, said canister containing a fire retardant material in a respectively pressurized environment;

control circuitry for actuating said valve, said control circuitry being securely coupled to an inner surface of said peripheral wall and being operationally coupled to said valve;

a sensor for sensing relatively high heat, said sensor being electronically coupled to said control circuitry, said sensor being securely attached to said peripheral wall; and a plurality of fastening members for removably fastening said top wall to said ceiling.

2. The fire extinguishing device as in claim 1, said housing further including:

a pair of doors each being hingedly coupled to a free edge of said peripheral wall for selectively closing said open bottom side, each of said doors being frictionally held in a closed position.

3. The fire extinguishing device as in claim 1, further including:

a propeller for disbursing said fire retardant material, said propeller being rotatably coupled to said canister and being positioned between said canister and said open bottom side.

4. The fire extinguishing device as in claim 3, further including:

a motor for rotating said propeller, said motor being positioned between said propeller and said canister and being mechanically coupled to said propeller, said motor being electrically coupled to said control circuitry.

5. A fire extinguishing device, said device being mountable to a ceiling, said device comprising:

a housing, said housing having a top wall, a peripheral wall being integrally coupled to and extending downwardly away from said top wall, said housing having an open bottom side, a pair of doors each being hingedly coupled to a free edge of said peripheral wall for selectively closing said open bottom side, each of said doors being frictionally held in a closed position;

a canister for disbursing a fire retardant material, said canister being securely coupled to an inner surface of said top wall such that a valve mechanically coupled to said canister is directed towards said open bottom side, said canister containing a fire retardant material in a respectively pressurized environment;

control circuitry for actuating said valve, said control circuitry being securely coupled to an inner surface of said peripheral wall and being operationally coupled to said valve;

a sensor for sensing relatively high heat, said sensor being electronically coupled to said control circuitry, said sensor being securely attached to said peripheral wall;

a power supply for powering said control circuitry, said power supply being electrically coupled to said control circuitry said power supply being positioned in said housing and comprising a battery;

a speaker for producing an audible sound being securely mounted in said housing and electrically coupled to said control circuitry;

a propeller for disbursing said fire retardant material, said propeller being rotatably coupled to said canister and being positioned between said canister and said open bottom side;

a motor for rotating said propeller, said motor being positioned between said propeller and said canister and being mechanically coupled to said propeller, said motor being electrically coupled to said control circuitry; and a plurality of fastening members for removably fastening said bottom wall to said ceiling, each of said fastening members comprising a screw extendable through said top wall and into said ceiling.

* * * * *